US006155466A

United States Patent [19]

Migliorini

[11] Patent Number: 6,155,466

[45] Date of Patent: Dec. 5, 2000

[54] APPARATUS FOR STRETCHING APART ONE END OF A TUBULAR ARTICLE

[75] Inventor: Pier Lorenzo Migliorini, Terranuova Bracciolini, Italy

[73] Assignee: Matec S.p.A., Italy

[21] Appl. No.: 09/417,677

[22] Filed: Oct. 14, 1999

Related U.S. Application Data

[63] Continuation-in-part of application No. 09/075,970, May 11, 1998, abandoned.

[30] Foreign Application Priority Data

Jun. 2, 1997 [IT] Italy ..... FI97A0135

[51] Int. Cl.[7] ..... D06C 5/00

[52] U.S. Cl. ..... 223/77; 223/75

[58] Field of Search ..... 223/112, 75, 76, 223/77

[56] References Cited

U.S. PATENT DOCUMENTS 5,058,516 10/1991 Maegawa et al. ..... 223/112
5,651,483 7/1997 Bell et al. ..... 223/112
5,769,286 6/1998 Conti ..... 223/75
5,884,822 3/1999 Migliorini ..... 223/1

*Primary Examiner*—Bibhu Mohanty
*Attorney, Agent, or Firm*—McGlew and Tutle, P.C.

[57] ABSTRACT

Apparatus for the opening or stretching apart of one end (10) of a tubular article (1), comprising a body (T) of substantially tubular shape, with an entry section (I) of the end (10) of the articles (1) to be treated and communicating with air suction means, in which downstream of the section (I) a converging-diverging conduit (2) is provided downstream of which, at a predetermined distance, there is a pin member (3) on which the end (10) of the article is to be fitted by virtue of the suction and of the expansion or opening caused by its transit along the region (20) downstream of the conduit (2). The body (T) is made up of two portions separable with respect to a central longitudinal plane (x—x) at least in correspondence of the above mentioned pin member (3) to allow the removal of the article (1) with its end (10) in streteched condition. (FIG. 1).

14 Claims, 5 Drawing Sheets

APPARATUS FOR STRETCHING APART ONE END OF A TUBULAR ARTICLE

This is a CIP of application Ser. No. 09/075,970 filed May 11, 1998 now abandoned, and the entire disclosure of this prior application is considered to be part of the disclosure of the accompanying application and is hereby incorporated by reference therein.

DESCRIPTION

The present invention refers to an apparatus for the opening or stretching apart of the end of a fabric tubular article such as a knitted stocking. It is known to those skilled in the art that the manufacturing of stockings and pantyhose articles requires carrying out a number of steps in predetermined sequence and whose character depends essentially on the type of article to be manufactured. For example, in the manufacturing of stockings, provision is made for starting from a knitted tubular article with the toe open and with one opposite end portion so worked as to present predetermined elastic characteristics. The individual articles are fitted on tubes of a so-called toe-closer machine which, in a number of steps, provides for sewing the above mentioned end portion. Once unloaded, the articles may be directed to a so-called line-closer machine which provides for the longitudinal cut of the more elastic portion of the articles, suitably fitted on pairs of supporting shapes, to allow the joining thereof in pairs by means of a sewing operated in correspondence of the edges being cut. One of the major problems in this technique lies in the automation of the various steps for the manufacturing cycle of the articles whether they are stockings or pantyhose articles. The main object of the present invention is to provide an apparatus particularly suitable for use in the manufacturing of articles of the above type and which allows for the integration of various parts of a production plant including machines for closing the toe and/or for the formation of pantyhose articles as well as for the automation of the steps for transferring the articles in the process of formation from a one machine to the other.

A further object of the present invention is to provided a significant reduction of the time relevant to the whole cycle for the manufacturing of the articles and, at the same time, the improvement in the quality of the finished product.

This result has been achieved, according to the invention, by providing an apparatus having a body with a tubular shape. Said body has first and second ends, with the first end receiving the tubular article and the second end being connectable to an aspiration means for selectively suctioning air through the body. A converging-diverging conduit is positioned in the body downstream of the first end. A pin member is then positioned downstream of the converging-diverging conduit and spreads out an air flow from the conduit, where the air flow spreads around the pin. The pin member is positioned relative to the conduit to cause an end of the tubular article, after it passes through the converging-diverging conduit, to open and surround the pin member due to the spreading of the air flow. The body with the pin is formed of first and second separable portions which separate from each other after the end of the tubular article is around the pin member. The separating of the first and second separable portions stretches open the end of the tubular article.

The advantages deriving from the present invention lie essentially in that it is possible to operate automatically the transfer of articles from one machine to the other of the production plant independently of the nature of the articles, that is, whether they are tubular items for the production of single stockings or tubular items to be joined for the formation of pantyhose articles; in that it is possible to reduce the time and cost of every production cycle; in that an apparatus according to the present invention is simple to make, cost-effective and reliable even after a prolonged service life.

These and other advantages and characteristics of the invention will be best understood by anyone skilled in the art from a reading of the following description in conjunction with the attached drawings given as a practical exemplification of the invention, but not to be considered in a limitative sense.

Figure 1:
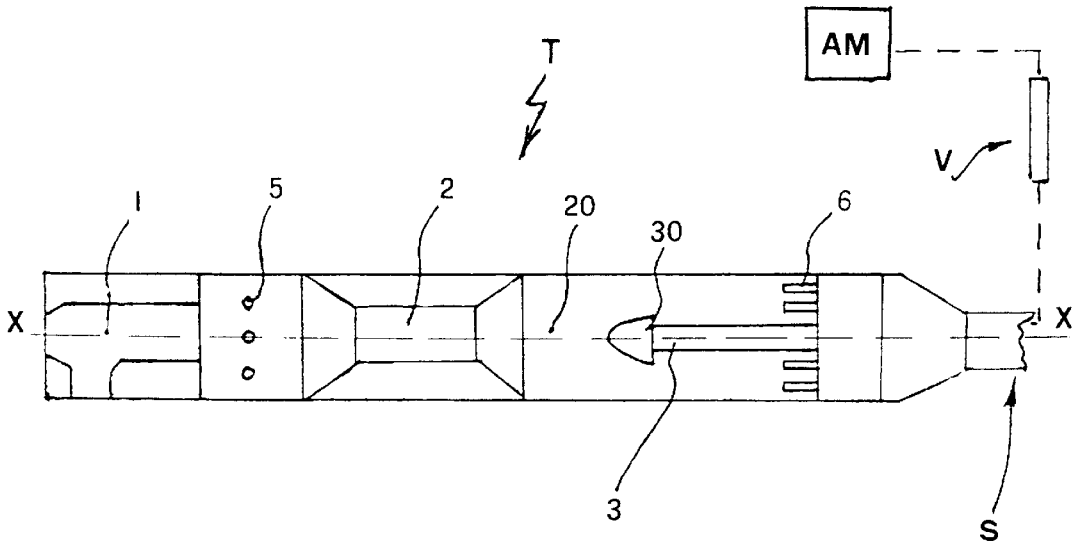
FIG. 1 is a schematic view along a horizontal plane of an apparatus according to the invention.

Reduced to its basic structure, and reference being made to the figures of the attached drawings, an apparatus for the opening or stretching apart of the elastic end (10) of a knitted tubular article (1) such as a stocking, comprises a body (T) with a tubular shape. Said body (T) has first and second ends (I), with the first end (I) receiving the tubular article (1) and the second end (S) being connectable to an aspiration means (AM) for selectively suctioning air through the body (T). The aspiration means generates a flow of air from the end (I) to the end (S) of the body (T). The aspiration means (AM) operates according to a selective pattern or program which turns on and off the flow of air through the body (T). This program actuates a system of valves (V) for intercepting the flow of suction air and the valves (V) are associated with a programmable control means. Such control means are per se known to those skilled in industrial automation. A converging-diverging conduit (2) is positioned in the body (T) downstream of the first end (I). A pin member (3) is then positioned downstream of the converging-diverging conduit (2), i. e. in the region (20) downstream of said conduit, and spreads out an air flow from the conduit (2), where the air flow spreads around the pin (3). The pin member (3) is positioned relative to the conduit (2) to cause an elastic end (10) of the tubular article (1), after it passes through the converging-diverging conduit (2), to open and surround the pin member (3) due to the spreading of the air flow. The body (T) with the pin member (3) is formed of first and second separable portions (A, B; 3A, 3B) which separate from each other after the end (10) of the tubular article (1) is around the pin member (3). The separating of the first and second separable portions stretches of the body (T) and pin member (3) open the end (10) of the tubular article (1). The pin member (3) is made up of two parts (3A, 3B), each part of the pin member (3) being associated with a corresponding part (A, B) of the body (T), so that separating of the two parts (A, B) of the body (T) is cause for the corresponding separation of the two parts (3A, 3B) of the pin member (3). In the present invention, the air suction means (AM) is operated to cause the transport of the article (1) from the first end (I) through the conduit (2) and the positioning of the article (1) on to the pin member (3).

Advantageously, the head (30) of said pin (3) may be shaped as an ogive.

For a simpler construction of the apparatus, the said body (T) may be made in two like parts which match, when in closed condition, in correspondence of a longitudinal plane of symmetry (X—X) and which result on opposite sides of the same plane (X—X) when the elastic (10) of the article (1) is in a stretched apart condition.

Figure 2:
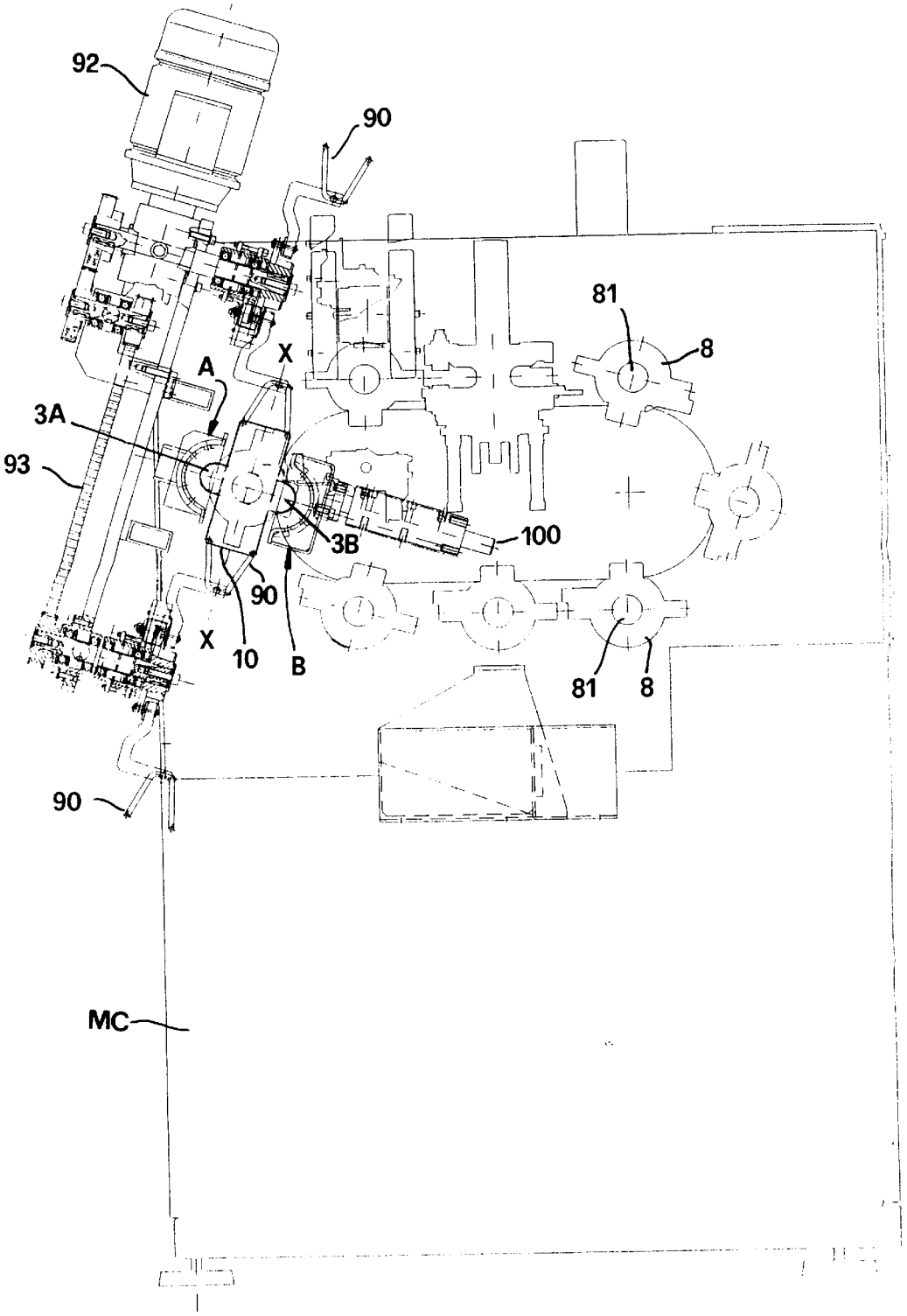
FIG. 2 is a view of the apparatus of FIG. 1 associated to a toe-closer machine with means for the transfer of the article from the apparatus to the machine.
Figure 4:
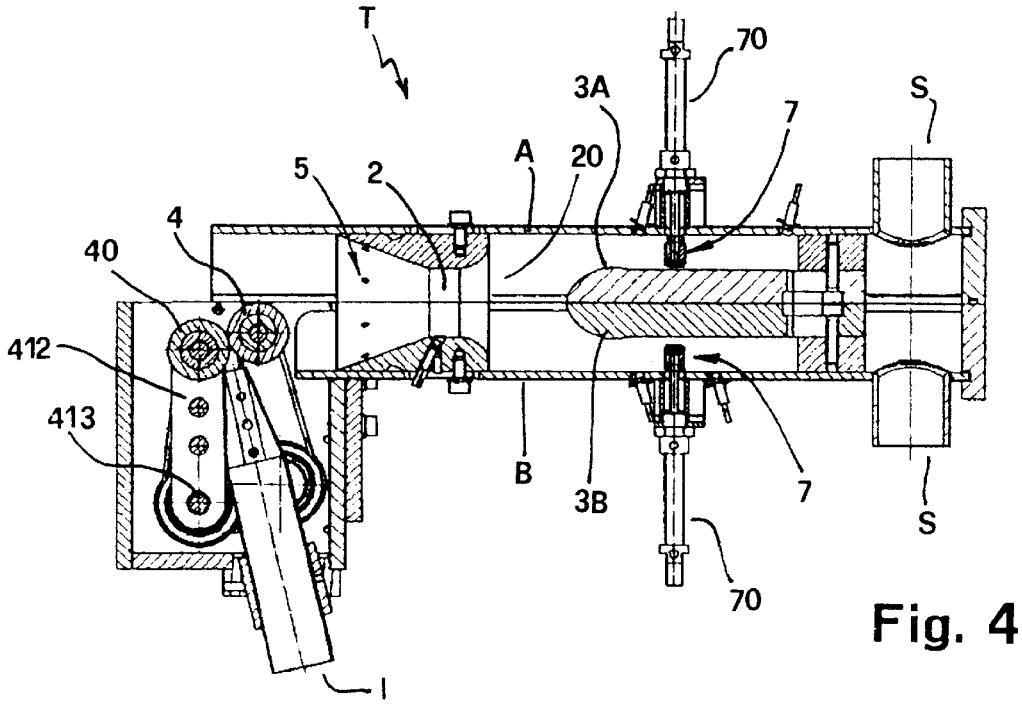
FIG. 4 is a schematic view in longitudinal section of an apparatus according to the invention, with the two parts of the body in a closed condition.
Figure 5:
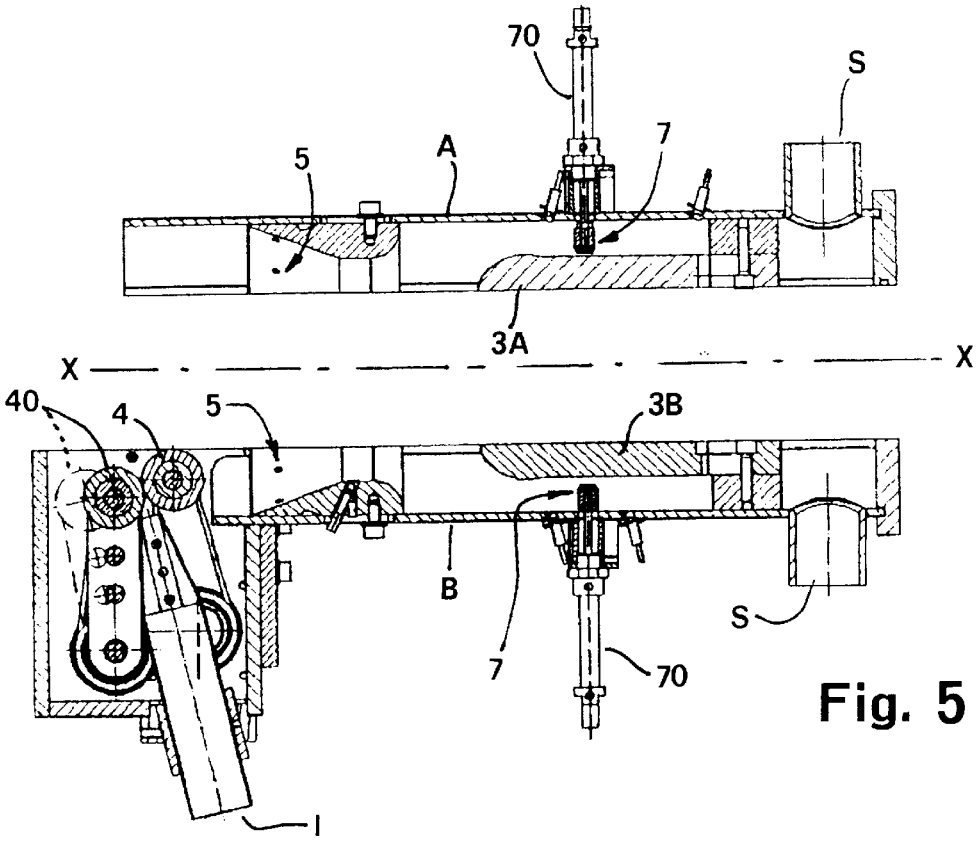
FIG. 5 is a schematic view like that of FIG. 4, with the two parts of the body in a separated condition.
Figure 6:
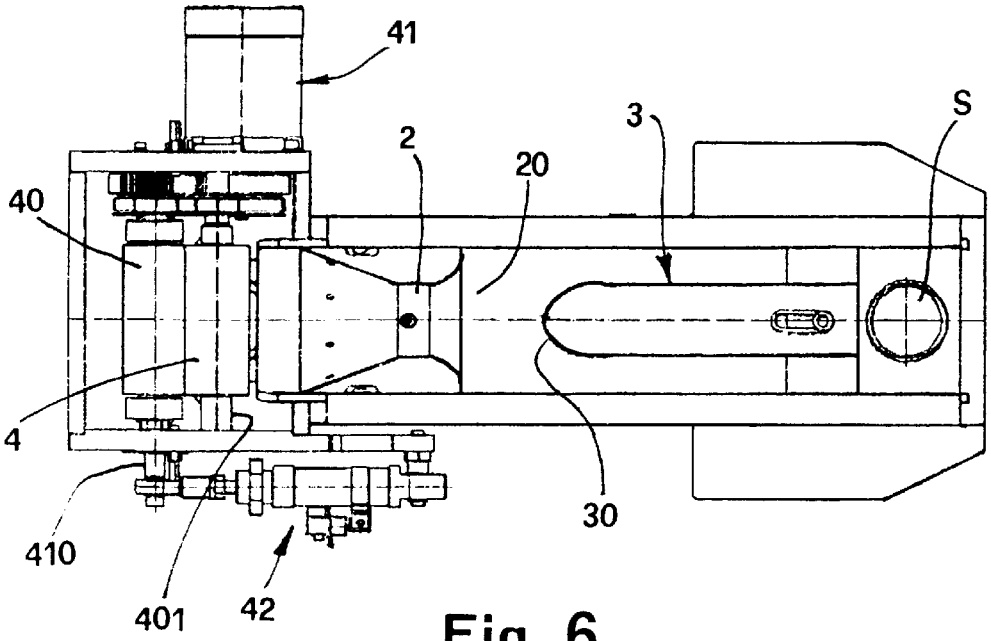
FIG. 6 is another schematic view of the present apparatus along a horizontal plane.
Figure 7:
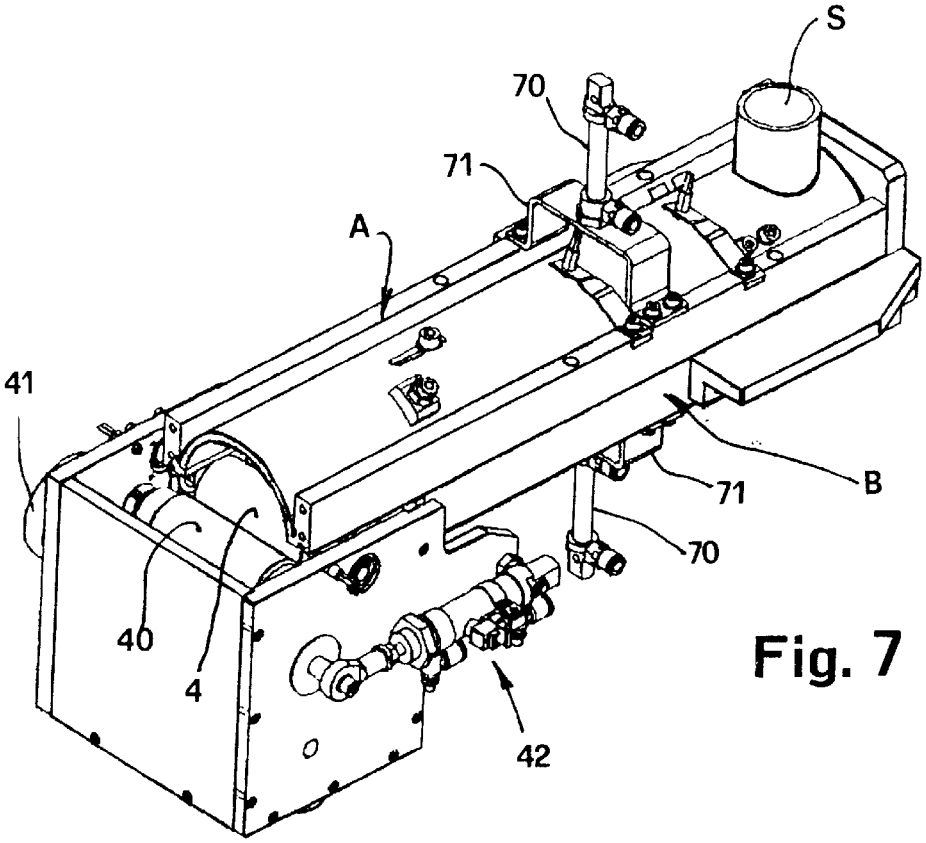
FIG. 7 is a perspective view of an apparatus according to the present invention.

Similarly, the two parts (3A, 3B) of the pin member (3) may be made in two like parts which match, when in closed position (as shown in FIGS. 4 and 7), in correspondence of said plane (X—X) and which result on opposite sides of the same plane (X—X) when the two parts (A, B) of the body (T) are separated (as shown in FIGS. 5 and 2).

Advantageously, according to the invention, in correspondence of the entry section (I), means are provided for adjusting the advancement speed of the article (1) within the body (T) by means of a pair of calander rollers (4, 40) associated to elastic means—not shown—and intended to compress the fabric of the advancing article (1). For example, a roller (4) is mounted onto a shaft (400) driven by an electric motor (41), the other roller (40) being mounted onto another shaft (410), parallel to the first one. The shaft (410) of the second roller (40) is movable from and to the first roller (4) by means of a cylinder (42) acting through an arm (412) an end of which is hinged about an axis (413) parallel to those (401, 410) of the rollers (4, 40). The shaft (410) of the roller (40) is supported by the arm (412), so that, since the activation of the cylinder (42) is cause for rotation of the arm (412) about its axis (413), the rollers (4, 40) are separated by activating the cylinder (42).

Even if not strictly necessary for the implementation of the apparatus according to the invention, means for adjusting the speed of the article (1), which are operatively equivalent to those described, may likewise be used.

Advantageously, according to the invention, in a position between the section (I) for the entry of the article (1) and the conduit (2), the body (T) exhibits a plurality of peripherical holes (5) to create a corresponding turbulence zone in the body (T) which facilitates the opening of the elastic (10) in case the latter is rolled up or is in a flat configuration.

In proximity of the section (S) associated to the aspirating means, the body (T) may advantageously exhibit a plurality of apertures or slits (6) able to favour a higher uniformity of suction in correspondence of the pin (3).

Moreover, advantageously, provision may be made for buffer means (7) movable from and to the pin (3) and acting on the fabric fitted thereon to compress it upon the stretching apart of the elastic, in order to ensure an even safer retention of the elastic (10) of article (1) onto the pin (3). Said buffer means (7) are associated with corresponding pneumatic actuators (70) each of which is solid with a corresponding part (A, B) of the body (T) through supports (71) which, in turn, are connected with the overall support or frame of the apparatus, as shown in FIG. 7. As shown in the drawings, the stem of each of said actuators (70) is mounted passing through a corresponding hole provided in the corresponding part (A, B) of the body (T) and the buffer means (7) are solid with the free end of the corresponding actuator stems. When the article (1) is being transported through the body by effect of the air flow, the said stems are away from the pin (3) to allow the article (1) to slip over the pin (3). Once the article (1) is over the pin (3), the stems are moved towards the pin (3), to clamp the article (1) between the stems and the pin.

The feeding of the articles (1), that is, the introduction thereof through the mouth or entry section (I) of the body (T) may be operated either manually or by disposing the body (T) at the exit of an apparatus for the automatic removal of the articles from a container, for example of a type described in the Patent Application IT FI96A163.

To obtain the stretching apart of the elastic (10), the latter is introduced through the section (I) of the body (T), with the suction being activated, so that, after the transit of the article portion with elastic (10) through the conduit (2), the elastic (10) will result open downstream of the conduit (2) as the edge of the elastic will follow the lines of flow of the air spreading out around the pin (3). Moreover, owing the predominance of the suction effect, the elastic with the edge thus opended or streched apart places itself and fits spontaneously onto the pin (3). With the successive opening of the body (T), that is, with the separation of its parts with respect to the longitudinal central plane (X—X), the elastic is further stretched apart, as best shown in FIG. 2, and is able to be removed also with mechanical means, for example of the type to be described below.

The said parts separable from the body (T) may be both movable under control of one or more mechanical or pneumatical separating devices or, as shown in FIG. 2, one part (A) is stationary and the other (B) is movable and associated to a pneumatic cylinder (100) which drives it into motion from and to the stationary part (A). The two parts (A, B) of the body (T) separate substantially to the right and the left in FIG. 2 and the end (10) of the tubular article (1) which is around the pin member (3) gets stretched apart by the separating of the two separable portions (A, B) of the body (T).

Figure 3:
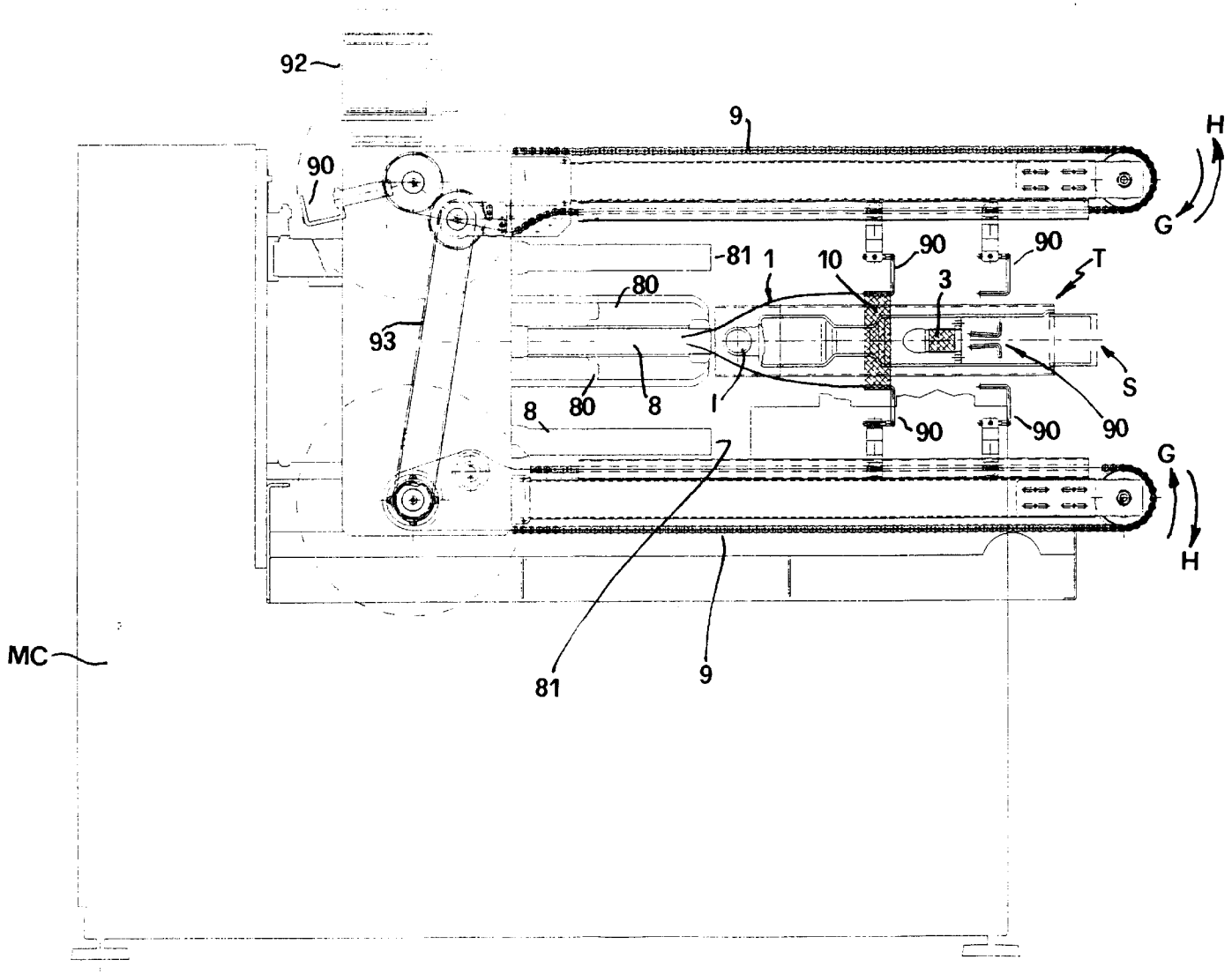
FIG. 3 is a simplified side view of the unit of FIG. 2.

As schematically illustrated in FIGS. 2 and 3 of the accompanying drawings, an apparatus according to the invention can be utilized for feeding the tubes (8) of a toe-closer machine (MC): the apparatus is placed upstream of the machine (MC) and is associated with a unit provided for transferring articles (1) having their elastic stretched apart, said unit comprising for example a plurality of hooks (90) carried by drive chains (9) associated to drive motor (92) via transmission chain (93), said chains being closed to form a loop and located on two opposite sides of the same apparatus disposed, for example, so as to result parallel to the tubes (8) and with the section (I) sufficiently close to the area of transit of the mouths (81) of said tubes. When the apparatus has the configuration in which the elastic (10) is open, i.e. when the separable portions of the body (T) are in the open or separated position and the pin member (3) is also separated and stretches the end 10 of the article 1 apart, the hooks (90), by advancing in the direction of tubes (8) of the toe-closer (MC), pick up the article in correspondence of the elastic (10) to place the same article on the lateral flyers (80) of the tubes (8). The suction activated within the tubes (8) will cause therefore the introduction into them of the end of the article (1) opposite to that of the elastic (10). In this step a blowing nozzle—not shown—located at the bottom in a position between the tube (8) and the body (T) may be advantageously used, the nozzle blow pushing said second end of the article towards the mouth of the tube (8). In this way, there is obtained the transfer of the articles from the apparatus (T) to the tubes (8) of the toe-closer (MC), with the elastic fitted on the flyers (80) thereof, as necessary for the correct operation of the toe-closer (MC).

The said chains (9) are mounted on corresponding flat supports (94) movable from and to the body (T) of the apparatus in question by means of actuator cylinders, which are not shown in the figures of the accompanying drawings for sake of clarity.

Arrows (G, H) in FIG. 3 show the movements of the above mentioned supports (94).

Arrow (G) indicates the movement made by the supports (94) for moving the hooks (90) toward the body (T), i.e. to a position where they are within the radius of the stretched apart end (10) of the article (1). The hooks (90) are then moved laterally, from left to right in FIG. 3, until the end of the hooks (90) are inside the open end (10) of the article (1). the hooks (90) to the far most right side in FIG. 3 have not yet been moved to within the radius of the stretched apart end (10) of the article (1). Once the hooks (90) are in the stretched apart end (10) of the article (1), the hooks (90) can move radially out, by moving the supports (94) as shown by arrows (H), and further to the left by the motorized chains (9). The article (1) is then removed from the pin member (3) and toward the tubes (8).

The toe-closer machine (MC) is known per se. U.S. Pat. Nos. 5,014,634, 5,272,993 and 4,020,775 describe toe closing machines for stockings.

The apparatus in question may be used for feeding the shapes of a pantyhose-sewing machine of the type so-called line closer, known per se to those skilled in the art. U.S. Pat. Nos. 4,444,140, 5,345,889 and 4,303,026 describe pantyhose-sewing machines. The feeding of a line-closer may be made by using a transfer apparatus fully similar to the one described above with reference to FIGS. 2 and 3 and intended to fit the articles with open elastic onto the shape of the line-closer instead of onto the above indicated tubes (8).

It should be appreciated that the articles able to be formed by the present apparatus may also be articles of non elastic fabric and that, in case of stockings manufacturing, the elastic portion to be opened up may be either the one in correspondence of the bodice, as illustrated in FIGS. 2 and 3 in the drawings, or the the one in correspondence of the toe.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. An apparatus for processing a tubular article, the apparatus comprising:

a body having a tubular shape with a first end receiving the tubular article, and having a second end connectable to an aspiration means for selectively suctioning air through said body;

a converging-diverging conduit positioned in said body downstream of said first end;

a pin member positioned in said body and downstream of said converging-diverging conduit, said pin member spreading out an air flow from said conduit around to around said pin member, said pin member being positioned relative to said conduit to cause an end of the tubular article passing through said converging-diverging conduit to open and surround said pin member due to said air flow;

first and second separable portions positioned in said body for separating after the end of the tubular article is around said pin member and stretching open the end of the tubular article.

2. The apparatus in accordance with claim 1, wherein:

said first and second separable portions allow for removal of the tubular article with the end stretched.

3. The apparatus in accordance with claim 1, wherein:

said first and second separable portions include portions of said pin member.

4. The apparatus in accordance with claim 1, wherein:

said body is divided between said first and second separable portions.

5. The apparatus in accordance with claim 1, wherein:

said first and second separable portions divide said body along a longitudinal plane of said body and are movable between an open and a closed position, said first and second separable portions being on opposite sides of said longitudinal plane in said open position, said first and second separable portions are shaped to be substantially identical and join when in said closed position.

6. The apparatus in accordance with claim 1, further comprising:

speed adjustment means positioned at said first end of said body for adjusting an advancement speed of the tubular article within said body, said speed adjustment means including a pair of calender rollers associated with elastic means for biasing said calender rollers together and for compressing the tubular article.

7. The apparatus in accordance with claim 1, wherein:

said body defines a plurality of peripheral holes positioned between said first end and said converging-diverging conduit.

8. The apparatus in accordance with claim 1, wherein:

said body defines a plurality of one of apertures and slits positioned at said second end.

9. The apparatus in accordance with claim 1, further comprising:

buffer means positioned on said body and for clamping the tubular article onto said pin member when said first and second separably portions stretch open the end of the tubular article, said buffer means being movable toward and away from said pin member.

10. The apparatus in accordance with claim 1, further comprising:

upstream removal means positioned upstream of said first end and for mechanical removal of the tubular articles from a container.

11. The apparatus in accordance with claim 1, wherein:

the article is a stocking.

12. The apparatus in accordance with claim 1, wherein:

the end of the tubular article is in correspondence of one of a bodice and toe of a stocking.

13. The apparatus in accordance with claim 1, further comprising:

a toe closing machine connected to said second end of said body.

14. The apparatus in accordance with claim 1, further comprising:

a line closer machine connected to said second end of said body for assembly of pantyhose articles.

* * * * *